US006926066B2

(12) United States Patent
Boulet

(10) Patent No.: US 6,926,066 B2
(45) Date of Patent: Aug. 9, 2005

(54) MAGNESIUM DIE CASTING SYSTEM

(76) Inventor: Alain Renaud Boulet, 770 Wright Street, Strathroy, Ontario (CA), N7G 3H8

( * ) Notice: Subject to any disclaimer, the term of this patent is extended or adjusted under 35 U.S.C. 154(b) by 0 days.

(21) Appl. No.: 10/706,273

(22) Filed: Nov. 13, 2003

(65) Prior Publication Data

US 2004/0129402 A1 Jul. 8, 2004

Related U.S. Application Data

(60) Provisional application No. 60/425,630, filed on Nov. 13, 2002.

(51) Int. Cl.[7] ..... B22D 17/30
(52) U.S. Cl. ..... 164/317; 164/337
(58) Field of Search ..... 164/312, 314, 164/317, 335, 337

(56) References Cited

U.S. PATENT DOCUMENTS 3,843,355 A * 10/1974 Reding ..... 75/409
4,061,176 A * 12/1977 Carbonnel ..... 164/61
4,571,258 A * 2/1986 Bamji et al. ..... 75/10.18
4,753,283 A * 6/1988 Nakano ..... 164/312
5,370,171 A * 12/1994 Fields et al. ..... 164/312
5,388,633 A * 2/1995 Mercer et al. ..... 164/457
5,914,440 A * 6/1999 Celik et al. ..... 75/407

* cited by examiner

*Primary Examiner*—Jonathan Johnson
*Assistant Examiner*—Len Tran
(74) *Attorney, Agent, or Firm*—Anissimoff & Associates; Robert A. H. Brunet

(57) ABSTRACT

An improved magnesium die casting system incorporates filling of the shot sleeve from the underside and/or in-line re-melting of scrap magnesium using a re-melt furnace. A pump is used to transfer molten magnesium from a casting furnace to the shot sleeve through an underflow filling tube. The shot sleeve is filled in a laminar manner, minimizing entrapped gases. The in-line re-melt system allows recycling of scrap in-house and reduces energy cost associated with heating and re-heating scrap. The improved system increases casting quality and reduces scrap rates and recycling costs.

20 Claims, 2 Drawing Sheets

MAGNESIUM DIE CASTING SYSTEM

CROSS-REFERENCE TO RELATED APPLICATIONS

This application claims the benefit of U.S. Patent application 60/425,630, filed Nov. 13, 2002.

FIELD OF THE INVENTION

The invention relates to an improved system for magnesium die casting. More specifically, the invention relates to an improved system for supplying molten magnesium to a die casting machine and/or for supplying recycled scrap magnesium to a die casting machine.

BACKGROUND OF THE INVENTION

Magnesium alloys are a strong and light weight alternative to traditional alloys, such as aluminum alloys. Although magnesium has a higher strength to weight ratio than aluminum, castings made from magnesium typically suffer from porosity, which compromises casting strength. As a result, many dies are currently designed to produce castings with features such as thicker ribs and wall sections, thus eliminating weight savings realized through the use of magnesium and making the finished part unacceptably high in cost. In order to increase utilization of magnesium in die casting applications, improved casting processes to increase the strength of the finished parts and reduce scrap costs are needed.

Magnesium die castings are typically made using techniques developed for aluminum die casting. These techniques generally are unsuitable when applied to magnesium die casting. One such technique relies on vacuum to transfer liquid alloy from the casting furnace to the die casting machine for subsequent injection into the die. Typically, a vacuum is used to evacuate the die cavity and, to draw the metal from the casting furnace into the die casting machine. In a die casting machine, a shot sleeve is normally provided for injection of the molten metal. The shot sleeve is a tube of sufficient volume to hold the full charge of molten metal needed to fill the die and the passages leading up to the die, called runners. The shot sleeve is normally evacuated along with the die cavity and molten metal flows into the shot sleeve from the top.

Filling the shot sleeve using a vacuum is difficult with magnesium because of the much higher filling temperature as compared with aluminum. The high temperature makes it difficult to maintain a vacuum seal and lead to excessive equipment maintenance. Also, since the cycle time between each shot sleeve filling operation is quite long, in excess of ten seconds, and since magnesium cools at a rate approximately three times faster than aluminum, the magnesium has a tendency to solidify within the shot sleeve and runners. This prevents pressure intensification of the molten casting. Pressure intensification is performed by the shot plunger immediately after injection, reducing casting porosity and causing the casting grain structure to be altered from dendridic to the more desirable globular grain structure, thereby improving the mechanical properties of the finished casting. Solidification prevents rapid pressure intensification, leading to poor part quality and large numbers of scrap castings. The long cycle times also do not permit economically acceptable production rates.

The manner in which the shot sleeve is filled also affects the quality of magnesium die castings. Improper filling of the shot sleeve can cause non-uniform metal flow, entrapment of gases that cause casting porosity, and segregation of impurities, such as magnesium oxide. These factors detrimentally affect the quality of the castings produced.

Research conducted with aluminum has shown that filling the shot sleeve from the bottom in combination with a vacuum can reduce some of these common problems. However, vacuum methods commonly used with aluminum cannot be readily applied to magnesium. The need therefore still exists for an improved magnesium die casting system to improve casting strength and reduce the number of scrap castings.

A pump, such as the one disclosed in U.S. Pat. No. 6,602,462, issued Aug. 5, 2003, which is hereby incorporated by reference, may be used to transfer molten magnesium from the melt furnace to the shot sleeve instead of a vacuum.

Magnesium die casting by nature produces a high percentage of scrap metal, typically 40 to 60% of the total shot weight. This can largely be attributed to the extensive runner system required to completely fill the die, which becomes scrap once the part is cast. In order to reduce material costs, it is desirable to recycle scrap magnesium. Magnesium re-cycling for automotive applications is currently done off-sit by approved recyclers in order to ensure final product purity. It is expensive to have magnesium recycled in this manner due to recycling costs, increased inventory requirements, and handling costs.

Scrap magnesium is sometimes recycled using in-house facilities. Typically, scrap magnesium metal is recycled using a flux based process, wherein surface metal oxides are wetted and agglomerate into globules of flux. The globules or spheres settle to the bottom of the melt and are removed as sludge from a bottom region. However, during globule formation, liquid metal is entrapped within the globules, resulting in a loss of recyclable material. The melt is also sparged with fine bubbles of an inert gas, such as argon. The argon forms a blanket of cover gas in the furnace that prevents contact with air. As a result of sparging, light weight impurities in the recycled material rise to the top of the melt and may be removed from a top region. Pure metal is withdrawn from a clean region between the top and bottom regions in about the center of the furnace.

Withdrawal of sludge from the furnace causes the melt level to drop, requiring a make-up addition of virgin magnesium. The withdrawal and addition of fresh material can lead to temperature fluctuations within the furnace and increased crucible maintenance. It is therefore desirable to reduce the amount of material withdrawn from the furnace as sludge and impurities. Also, flux cannot be introduced into the die castings and flux based processes are typically conducted off-line to minimize the risk of casting contamination. Scrap is cooled, taken to the off-line recycling centre, re-heated in a furnace, then cast into ingots and cooled. The cooled ingots are then introduced into the casting furnace for use in making die castings. The cooling and re-heating of the scrap material consumes a great deal of energy, making off-line flux based recycling processes expensive and impractical.

The need therefore still exists for an improved magnesium die casting system incorporating recycling process.

SUMMARY OF THE INVENTION

According to an aspect of the invention, a magnesium die casting system comprises a casting furnace for producing molten magnesium alloy, a pump for transferring the molten magnesium alloy, and a die casting machine having a shot sleeve for receiving the molten magnesium alloy, the shot sleeve adapted for filling from the underside thereof.

The shot sleeve may be adapted to include sealing means between the shot sleeve and a conduit used to transfer the molten magnesium alloy into the shot sleeve. The sealing means may comprise a high temperature sealing material, for example, a ceramic material. The molten magnesium may be transferred through an underflow filling tube at a certain flow rate. The flow rate may be modulated according to an algorithm. The algorithm may incorporate adaptive control techniques. The shot sleeve may be adapted by heating the shot sleeve. The shot sleeve may be adapted by the addition of gas flow ports. The gas flow ports may be used to evacuate the shot sleeve prior to or in conjunction with filling the shot sleeve with molten magnesium. The shot sleeve may be adapted through the addition of an insulating material.

According to another aspect of the invention, there is provided a magnesium die casting system for in-line recycling of scrap magnesium, the system comprising a re-melt furnace in fluid communication with a casting furnace in fluid communication with a pump for supplying molten magnesium to a die casting machine that produces solid castings and solid scrap, the solid scrap introduced into the re-melt furnace.

The in-line re-melt system may function without the use of flux. The in-line re-melt system may incorporate automatic scrap handling, for example using a robot. The re-melt furnace may include a plurality of heating zones that may be independently controlled. Each heating zone may include one or more heating elements. The heating elements may be inductive. The heating elements may be resistive. The heating elements may be SCR's. Each heating zone may comprise an insulating material. A different insulating material may be used in one or more zones. The heating elements may be located adjacent the insulating material. An adaptive control algorithm may be used to control the temperature in the re-melt furnace. The re-melt furnace may be provided with a plurality of temperature sensors located at a plurality of positions within the furnace. The temperature sensors may be located within different regions of the molten metal within the re-melt furnace. The re-melt furnace may be in fluid communication with the casting furnace through a U-shaped tube. The U-shaped tube may function by siphoning. The U-shaped tube may be heated. The U-shaped tube may be used to maintain a similar molten metal level in both th re-melt and casting furnaces. The U-shaped tube may comprise a filter. The filter may be formed from a ceramic material. The filter may be used, to exclude impurities and/or sludge from the U-shaped tube and the casting furnace. The re-melt furnace may comprise a crucible. The crucible may be shaped to promote stratification within the crucible. The crucible may include one or more baffles. The baffle or baffles may be removable. The baffle or baffles may be insulated or made from an insulating material. The baffle or baffles may be used to promote a desired temperature profile within the crucible.

The shot sleeve may be filled from the underside through and underflow filling tube. Filling from the underside provides laminar filling characteristics and prevents splashing within the shot sleeve. Filling the shot sleeve from the underside also causes the molten metal to push gases out of the shot sleeve as it is being filled, preventing entrapment of gases which can lead to casting porosity and poor part quality.

A pump may be used to fill the shot sleeve from the underside, providing a laminar fill with minimal alloy turbulence in an acceptable amount of time to prevent excessive magnesium cooling. The cycle time may be dramatically shortened to less than six seconds, preferably four seconds, by use of the pump. This ameliorates solidification concerns and provides an economically acceptable cycle time. A fast fill rate, with a proper injection profile, can reduce or eliminate the aforementioned shot sleeve filling problems.

The die and/or shot sleeve may be re-designed to accommodate filling from the underside. Special provisions may be made to maintain temperatures at optimal levels in the various stages of the filling operation. These temperatures may be at or near the melting temperature of the magnesium alloys used, for example from 650–700° C., preferably 680° C.

Through use of the pump, the filling from the underside can be conducted with only a slight vacuum to evacuate the die cavity, runners, and shot sleeve, since vacuum is not being used to transfer the molten metal into the shot sleeve. The vacuum may be, for example, from 0.1 to 2 psi. The vacuum may be applied to the shot sleeve immediately upon die closure, thereby reducing cycle time. The shot sleeve may be filled while the die is closed, also reducing cycle time, since the shot sleeve may be filled in preparation for injection into the die as soon as the die becomes available.

The pump permits the molten magnesium alloy to be transferred at close to the casting temperature with minimal heat loss. This reduces the tendency for solidification and porosity and permits rapid pressure intensification. The finished casting may be heat treated, further improving casting mechanical properties. Filling from the underside of the shot sleeve also allows the die design to be modified to provide a more efficient runner and gate system, reducing the amount of scrap associated with each casting.

The shot sleeve is preferably filled using an underflow filling tube at a certain flow rate that provides a laminar flow regime within the shot sleeve. It is desirable to select a flow rate that minimizes splashing within the shot sleeve. The flow rate is dependent on the size of the shot sleeve and the volume of the part to be cast. The shot sleeve is preferably filled in a manner that allows all entrapped bubbles to separate from the molten magnesium and be removed from the shot sleeve prior to injection of the molten magnesium into the die.

Existing die casting machines may be retrofit to accommodate filling from the underside.

The shot sleeve diameter may be reduced when filling from the underside as compared with filling from the top of the shot sleeve.

The shot sleeve may be connected to a heated portion of the underflow filling tube, thereby permitting molten metal to be transferred at close to the optimal casting temperature and permitting the optimal casting temperature to be more readily maintained in the shot sleeve.

In order to further improve part quality and reduce scrap costs, it is desirable to re-cycle magnesium in-line with a fluxless re-melt furnace. This allows on-site quality control and eliminates the cost associated with sending scrap magnesium off-site for recycling. In order to maintain casting quality, the ratio of recycled scrap material to virgin material in the furnace should be carefully controlled. Factors affecting the acceptable ratio include the die design, metal loss due to segregation, quality of the scrap material being fed and alloy chemistry. The ratio of recycled scrap material to virgin material may be 15–45%, preferably 30%, depending on the aforementioned factors.

In order to ensure quality of the recycled material when using a fluxless re-melt furnace, it is important to design the re-melt furnace to maintain desired temperature profiles and to monitor the purity of the clean region.

Temperature may be controlled by placing furnace heating elements within one or more heating zones along the sides and/or bottom of the re-melt furnace. The heating elements may be adjacent the crucible. The heating zones may comprise heat transfer materials of differing thermal properties. The heating elements may be located adjacent the heat transfer materials. The heat transfer materials may have insulating properties. Individual heating elements may deliver heat at different rates, depending on which heating zone they are located in. A feedback control algorithm may be used to control the temperature in the re-melt furnace. The control algorithm may make use of temperature sensors located at various positions within the molten metal, for example, in the clean region, the upper oxide region, and the lower sludge region. The control algorithm may use adaptive control techniques, such as neural networks.

In order to maintain purity, sludge and oxides mayt be continuously withdrawn from the bottom and top regions, respectively, of the molten metal within the furnace. Certain constituents of the alloy may be withdrawn at a higher rate than other constituents, changing the chemistry of the alloy. For example, a small decrease in manganese and beryllium through oxidation may occur. In order to ensure final part quality, monitoring of re-melted metal purity is required. Contaminant levels may be checked on a continuous or batch basis. If either oxide levels or impurity content deviate from acceptable limits, appropriate steps may be taken to ensure that the contaminated material is not used to make parts, for example, segregation. Actions may be taken to maintain alloy chemistry, such as the re-introduction of alloy constituents that have been depleted. Also, at low recycle ratios, the addition of virgin material may be sufficient to maintain alloy chemistry within acceptable limits. Virgin material may be pre-heated outside the furnace to reduce temperature fluctuations within the furnace. The fluxless process produces less sludge than flux based processes, reducing the amount of virgin alloy that must be added and also reducing the associated temperature fluctuations.

Organic contaminants, such as die spray and plunger lube are pyrolyzed due to the high temperatures in the re-melt furnace. These impurities can contaminate the cover gases in the re-melt furnace; accordingly, cover gases may be replaced on a batch or continuous basis to ensure cover gas purity.

Reduction in operating cost of the system is achieved through sparging and/or filtering metal only as it is being transferred to the shot sleeve. This in turn reduces the amount of cover gas needed. A sparging technique may be used that provides consistently small argon bubble size to ensure thorough contact with the re-melted metal. The sparger may be designed to produce small bubbles and may use a porous ceramic element to aid in bubble creation. The oxides that float to the surface of the melt may be removed by skimming the top of the melt with a multi-layered ceramic filter.

To further ensure recycled alloy purity, the transfer of magnesium from the re-melt furnace to the casting furnace may be done through a U-shaped tube. The U-shaped tube connects both furnaces, allowing free flow of molten magnesium between the two units, for example, by siphoning. This in turn maintains a similar molten alloy level in both furnaces. Changes in level may be used in part to determine the amount of virgin material that must be added to the re-melt furnace. The end of the tube in the re-melt furnace may be positioned at the center of the bath to ensure that only high purity material is withdrawn from the re-melt furnace. The tube prevents exposure of the re-melted material to air and reduces contamination concerns. The U shaped tube may be fitted with a special filter to further ensure magnesium alloy purity by excluding sludge or other impurities from the U-shaped tube. The filter may be made from a ceramic material. The filter and U-shaped tube may be designed to permit changing or cleaning of the filter during operation of the re-melt furnace to prevent excessive down time and alloy cooling.

Due to the high temperatures involved, automation of part removal and scrap trimming processes using a robot or similar means may be used. The robot may then quench the cast part only, not the runner system, and place the casting in a trim press without releasing the runner. Once the part is trimmed, the robot adds the runner to the re-melt furnace for recycling. Since the runner system being fed into the re-melt furnace is already hot, there is a resulting energy savings when an in-line recycling system is used. Automation reduces the likelihood of contamination of the scrap portion of the casting due to reduced handling. An air-lock may be used to introduce scrap magnesium to prevent the introduction of air and/or contaminants to the re-melt furnace that may affect cover gas purity. The air-lock may have a lid that opens in a clam-like fashion. The air-lock may be referred to as a clam-shell.

BRIEF DESCRIPTION OF THE DRAWINGS

Having summarized the invention, preferred embodiments thereof will now be described with reference to the accompanying figures, in which.

DETAILED DESCRIPTION OF THE INVENTION

Figure 1:
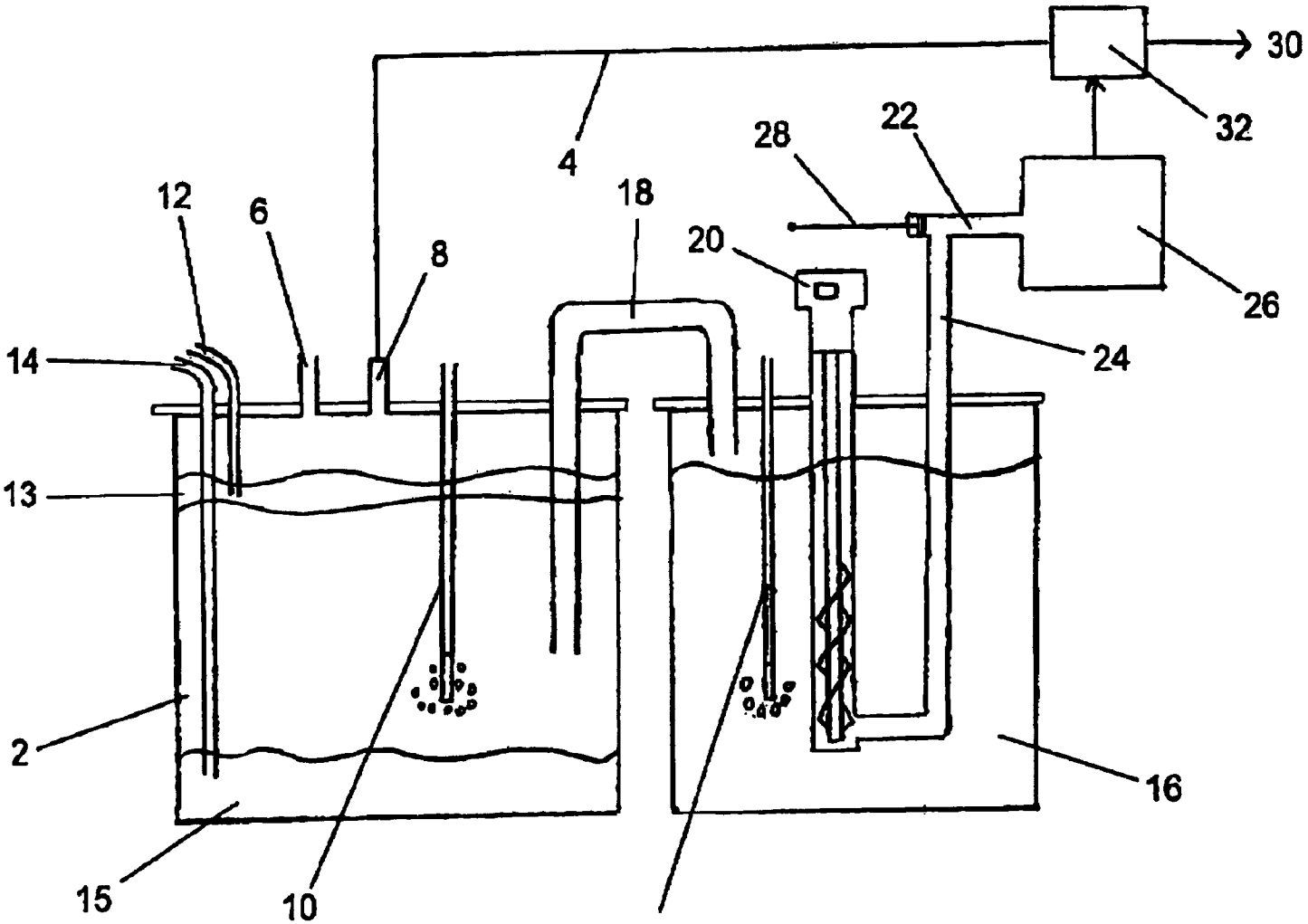
FIG. 1 shows a schematic of a die casting system according to the present invention.

With reference to FIG. 1 the in-line re-melt system is described. The re-melt furnace has a scrap opening 8 for feeding of scrap material by the robot. A virgin opening 6 is also provided to allow feeding of pre-heated virgin magnesium material for mixing with the re-cycled material. Both feeding operations are performed without introducing contaminants, such as gases, that might adversely affect the metal purity. Sparging with inert gases is performed using a sparger 10 situated within the furnace. Impurities are stratified within the re-melt furnace to create at least three regions. Light weight impurities, such as oxides, float to the top region 13. Heavy impurities, such as sludge, sink to the bottom region 15. A clean region 2 is maintained between the top and bottom regions. The stratified impurities are withdrawn from the top region 13 using top withdrawal tube 12 and from the bottom region 15 using bottom withdrawal tube 14. Impurities are withdrawn in either a continuous or batch-wise operation. The clean metal from the clean region 2 of the re-melt furnace is then transferred to the casting furnace through the U shaped tube 18. The casting furnace is used to provide a casting temperature to the molten metal prior to introduction to the shot sleeve. The casting furnace includes a sparger 19 to maintain purity within the casting furnace. A pump 20 is located within the casting furnace. The pump 20 is used to rapidly transfer molten magnesium from the casting furnace to the underside of the shot sleeve 22 through the underflow filling tube 24. The underflow filling tube 24 allows laminar filling of the evacuated shot sleeve 22, preventing entrapment of gases. The shot sleeve 22 is designed to maintain the metal at the desired injection temperature during this process. The molten magnesium in the shot sleeve 22 is then rapidly injected into the die casting machine 26 and solidified under pressure using the shot sleeve plunger 28. The pressure solidification results in a globular grain structure providing the desired mechanical properties to the finished casting. The finished part is then removed from the die casting machine 26, for example using a robot (not shown) and the part, excepting the runner portion, is quenched, shown schematically at the quench and trim station 32. The runner is then trimmed using a trim press, shown schematically at quench and trim station 32, and the hot runner is re-introduced as scrap into the re-melt furnace by the robot, shown schematically by line 4. The finished casting is taken away, shown schematically by line 30.

Figure 2:
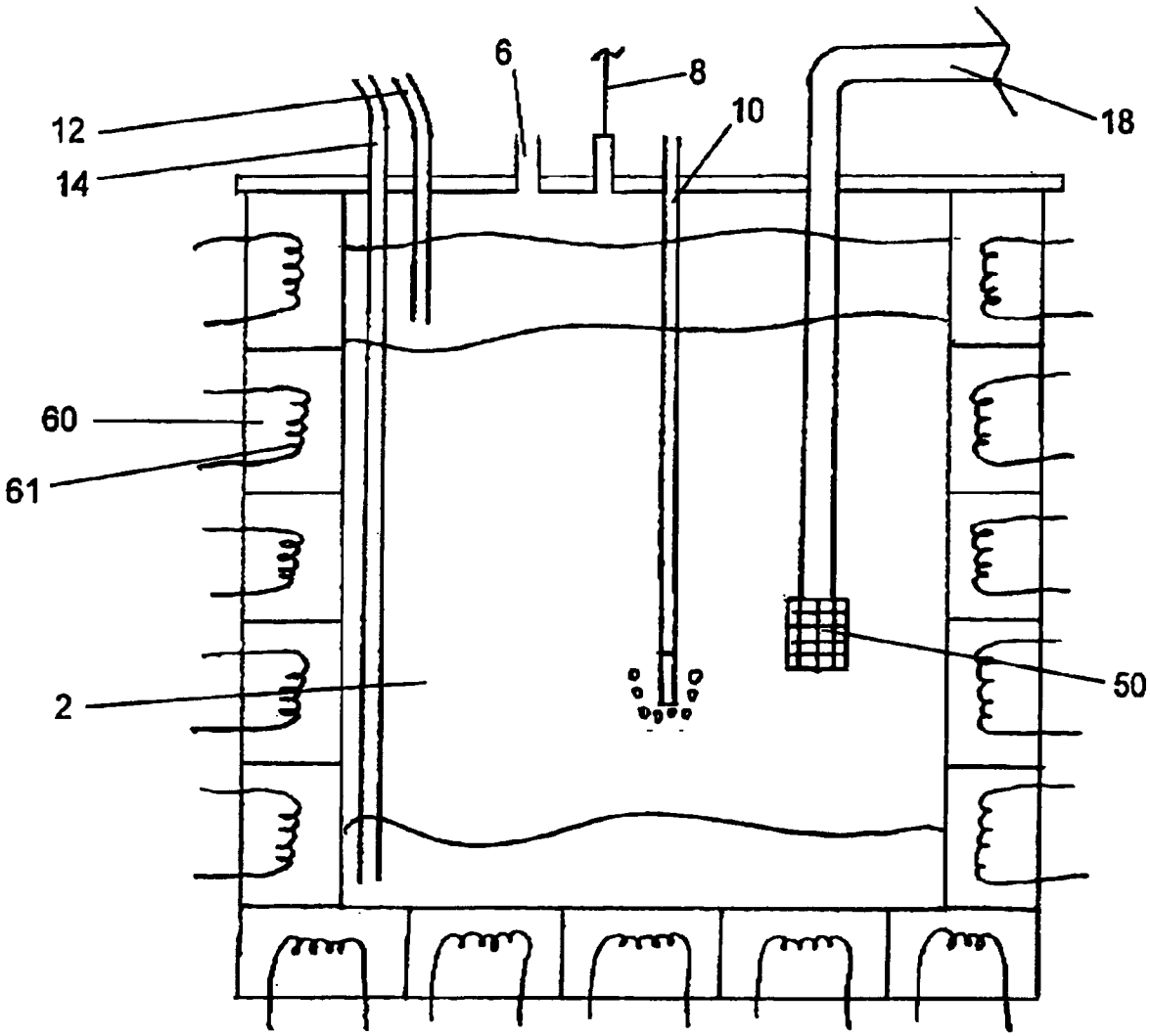
FIG. 2 shows a schematic of a re-melt furnace according to the present invention.

Turning to FIG. 2, a re-melt furnace is further described. A plurality of heating elements 61 are provided in independent heating zones around the outside of the crucible. The heating elements 61 are adjacent a heat transfer material 60. Different heat transfer materials 60 may be used in different heating zones. The heating elements 61 may deliver different amounts of heat energy to different heating zones. The clean region 2 within the furnace supplies molten metal to the casting furnace through U shaped transfer tube 18. A filter 50 may be provided as part of the U-shaped transfer tube to reduce the likelihood of an inadvertent transfer of impurities from the re-melt furnace to the casting furnace. Virgin metal is introduced through virgin port 6 and scrap metal is introduced through scrap port 8. These ports are shown schematically and are not intended to represent the size or design of the actual ports. Light impurities are withdrawn through top withdrawal tube 12 and heavy impurities are withdrawn through bottom withdrawal tube 14.

From the foregoing, it will be seen that this invention is one well adapted to attain all th ends and objects hereinabove set forth together with other advantages which are obvious and which are inherent to the structure.

It will be understood that certain features and sub-combinations are of utility and may be employed without reference to other features and sub-combinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

A person skilled in the art will recognize that variants or mechanical equivalents may be substituted for certain of the previously described features without having an effect on the way in which the invention works.

What is claimed is:

1. A magnesium die casting system for in-line recycling of scrap magnesium, the system comprising a re-melt furnace in fluid communication with a casting furnace in fluid communication with a pump for supplying molten magnesium to a die casting machine that produces solid castings and solid scrap, the solid scrap re-introduced into the re-melt furnace, the re-melt furnace comprising a plurality of heating zones, each heating zone comprising a heat transfer material, and wherein a different heat transfer material is used in one or more zones.

2. The magnesium die casting system of claim 1, wherein each heating zone includes one or more heating elements and wherein the heating elements are located adjacent the heat transfer material.

3. A magnesium die casting system for in-line recycling of scrap magnesium, the system comprising a re-melt furnace in fluid communication with a casting furnace in fluid communication with a pump for supplying molten magnesium to a die casting machine that produces solid castings and solid scrap, the solid scrap re-introduced into the re-melt furnace, the re-melt furnace comprising a plurality of temperature sensors located at a plurality of positions within the furnace.

4. The magnesium die casting system of claim 3, wherein the temperature sensors are located within different regions within the re-melt furnace.

5. A magnesium die casting system that includes in-line recycling of scrap magnesium, the system comprising:

a) a re-melt furnace, the re-melt furnace comprising a crucible containing molten magnesium stratified into three regions: an upper region; a lower region; and, a clean region between the upper and lower regions;

b) a casting furnace in fluid communication with the re-melt furnace by siphoning through a U-shaped tube having an inlet located within the clean region and an outlet located within the casting furnace;

c) a die casting machine comprising a shot sleeve and a die, the die casting machine for producing solid magnesium die castings and solid magnesium scrap;

d) a pump located within the casting furnace for supplying molten magnesium directly to the shot sleeve of the die casting machine through a filling tube connected to the shot sleeve; and, e) means for re-introducing the solid magnesium scrap into the re-melt furnace that substantially prevents the ingress of air into the re-melt furnace.

6. The magnesium die casting system of claim 5, wherein the ratio of scrap material to virgin material in the furnace is from 15% to 45%.

7. The magnesium die casting system of claim 5, wherein the magnesium die casting system comprises means for monitoring purity of the molten magnesium in the middle zone.

8. The magnesium die casting system of claim 5, wherein the magnesium die casting system comprises means for continuously monitoring purity of the molten magnesium in the middle zone.

9. The magnesium die casting system of claim 5, wherein the crucible is shaped to promote stratification of the molten magnesium into the at least three regions.

10. The magnesium die casting system of claim 5, wherein the re-melt furnace includes a plurality of heating zones that may be independently controlled.

11. The magnesium die casting system of claim 10, wherein each heating zone includes one or more heating elements that may be used to deliver different amounts of heat in each heating zone.

12. The magnesium die casting system of claim 5, wherein the U-shaped tube comprises a filter for excluding impurities and/or sludge from casting furnace.

13. The magnesium die casting system of claim 5, wherein the crucible includes one or more baffles.

14. The magnesium die casting system of claim 13, wherein the baffle or baffles is/are removable.

15. The magnesium die casting system of claim 5, wherein the means for re-introducing the scrap magnesium comprises an air-lock.

16. The magnesium die casting system of claim 5, wherein the re-melt furnace includes means for withdrawal of impurities from the upper and lower regions.

17. The magnesium die casting system of claim 5, wherein the re-melt furnace includes means for re-introduction of alloy constituents.

18. The magnesium die casting system of claim 5, wherein the re-melt furnace comprises a temperature sensor located within each region of the re-melt furnace.

19. The magnesium die casting system of claim 5, wherein re-melt furnace does not use flux.

20. The magnesium die casting system of claim 5, wherein the filling tube is connected to an underside of the shot sleeve.

* * * * *